United States Patent [19]

Shimada et al.

[11] Patent Number: 4,705,702

[45] Date of Patent: Nov. 10, 1987

[54] PROCESS FOR CONTINUOUSLY DISTRIBUTING FIBROUS MATERIAL AND APPARATUS THEREFOR

[75] Inventors: Masaaki Shimada; Koji Saito; Yoshiaki Midorikawa, all of Iwaki, Japan

[73] Assignee: Kureha Kagaku Kogyo Kabushiki Kaisha, Tokyo, Japan

[21] Appl. No.: 876,674

[22] Filed: Jun. 19, 1986

[30] Foreign Application Priority Data

Jun. 28, 1985 [JP] Japan ..... 60-140477

[51] Int. Cl.[4] ..... B05D 1/14

[52] U.S. Cl. ..... 427/180; 118/308; 118/312

[58] Field of Search ..... 118/308, 312; 427/180, 427/206; 222/161, 199, 200, 565

[56] References Cited

U.S. PATENT DOCUMENTS

| | | | |
|---|---|---|---|
| 2,632,588 | 3/1953 | Hoar | 222/161 X |
| 2,757,635 | 8/1956 | Lipsius | 118/308 X |
| 2,896,673 | 7/1959 | Mitlin et al. | 222/199 X |
| 3,333,537 | 8/1967 | Proskauer | 222/199 X |
| 3,528,386 | 9/1970 | Morine | 222/161 X |
| 4,243,696 | 1/1981 | Toth | 427/180 X |
| 4,617,231 | 10/1986 | Hamada et al. | 427/180 X |

FOREIGN PATENT DOCUMENTS

| | | | |
|---|---|---|---|
| 485320 | 5/1917 | France | 427/206 |

*Primary Examiner*—Shrive P. Beck

*Attorney, Agent, or Firm*—Wenderoth, Lind & Ponack

[57] ABSTRACT

A process and an apparatus for distributing short fibrous material onto a horizontally travelling sheet. A disintegrated short fibrous material is fed into a hopper comprising a substantially hollow casing disposed above the travelling sheet and having a fiber discharge port at a lower portion with of a side wall on the downstream side. A mesh having a width equal to or larger than that of the travelling sheet and having partitions provided thereabove for suppressing the transverse movement of the fiber is provided below the hopper and with a spacing above the travelling sheet. The mesh screen is horizontally and transversely vibrated to distribute the fiber therethrough onto the travelling sheet, whereby the fiber is uniformly distributed without causing pilling even if it is fed at a considerably small rate.

22 Claims, 8 Drawing Figures

H=20 mm x3

H=100 mm x3

H=150mm x3

H=50mm x2

H=200mm x2

H=500mm x2

PROCESS FOR CONTINUOUSLY DISTRIBUTING FIBROUS MATERIAL AND APPARATUS THEREFOR

FIELD OF THE INVENTION AND RELATED ART

The present invention relates to a process for distributing and uniformly dispersing a short fibrous material onto a continuously-travelling sheet-like shaped material of any thickness inclusive of film, sheet, mat and plate (which will be inclusively referred to as "sheet" hereinafter), and an apparatus therefor.

For example, a resinous sheet having electroconductive fiber uniformly dispersed on the surface thereof, which has been produced by using a resinous sheet as an example of the sheet and conductive fiber as an example of the fiber, may be formed into an electromagnetic wave-shielding sheet or a conductive molding material by fixing the fibers on the surface into the resinous matrix of the sheet while the resinous sheet is being transferred.

As methods for incorporating a fibrous material into a resinous material in the production of the above-mentioned conductive film or conductive synthetic resin shaped material as electronic materials illustrated as an example of application of the present invention, in general, the following various processes have hitherto been adopted:

(1) A process comprising mixing conductive fiber with a molten thermoplastic syntheric resin and forming the mixture into a sheet or film by an extruder.

(2) A process wherein a conductive fiber is mixed with a thermoplastic synthetic resin fiber (polyolefinic synthetic pulp) and/or vegetable fiber (wood pulp) in a dispersing medium (in a wet system); the mixture is subjected to a paper-making process to form a blend paper; and the paper is dried and hot-pressed to produce an electroconductive film or sheet (Japanese Laid-Open Patent Application Nos. 26597/1984 and 213730/1984 and Japanese Patent Application No. 239561/1984).

(3) A process comprising placing and hot-pressing a woven fabric of, e.g., conductive fiber, onto a thermoplastic synthetic resin film or sheet to produce a film or sheet.

(4) A process which comprises dropping and distributing conductive fiber onto a sheet of thermoplastic resin alone produced by melt extruding, while cutting the conductive fiber into slivers and subjecting them to hot-pressing at a temperature higher than a softening point of the thermoplastic resin (Japanese Laid-Open Patent Application No. 217345/1983).

(5) A process for depositing short fiber by suction onto a continuously travelling gas-permeable sheet while disintegrating the short fiber by using a compressed air medium (Japanese Laid-Open Patent Application Nos. 49928/1984 and 49929/1984).

However, the above-mentioned processes are respectively accompanied by the following problems.

In the process (1), the severance of the fiber occurs during mixing the thermoplatic synthetic resin with the conductive fiber and further, the orientation of the fiber is caused by the melt extrusion, resulting in a difficulty in forming a uniform film or sheet having a desired conductivity.

In the process (2), the energy for drying the wet blended paper is excessively consumed, and unevenness in thickness during paper-making reaches as large as a factor of 4 to 5 and hence, it is not easy to provide a uniform film.

In the process (3), the use of the woven fabric causes the conductive fiber to be used in an amount larger than required, thus being uneconomical.

In the process (4), the slivers are dropped and dispersed, but even cut fibers are entangled during dropping to become rebundled and therefore, the uniform dispersion thereof on the resinous sheet is not ensured. On the other hand, the unevenness in distribution is not remarkable when the amount of conductive fiber per unit area (amount of fiber distributed) in the conductive sheet is larger. Because it is desirable, however, that the product sheet is transparent when used as a packaging paper so that the content is seen therethrough, the amount per unit area should be controlled to a smaller level of 300 to 400 g/m$^2$ or less. In such a case, nothing is solved with respect to the problem of the remarkable unevenness in distribution. Particularly, in producing a wider composite resinous sheet, the uniform distribution of fiber in a smaller amount is significantly required.

In the process (5), not only a fiber distribution face on which the fiber is distributed is limited to that given by a gas-permeable sheet which permits air as a medium used for disintegrating and transferring the fiber to pass therethrough while leaving the fiber dispersed thereon, but also a huge cost is required for treatment of dust produced with process may not be regarded as an economical process.

SUMMARY OF THE INVENTION

It is an object of the present invention to provide a process and apparatus for distributing a fibrous material wherein the problems found in the prior art processes are overcome, and wherein a short fibrous material can be more simply distributed even in such a small amount that the amount per unit area reaches 0.1 gm$^2$ as a possible lower limit on a moving sheet. More specifically, present invention aims at accomplishing the following objects while using a resinous sheet as the sheet.

(1) To avoid the use of a particular dispersing medium for fiber dispersion.

(2) To ensure a uniform dispersion of a fibrous material even in such a case that the fibrous material is dispersed in a small dispersion rate of the order of 0.1 g/m$^2$-sheet as required for imparting a transparency which in turn is required for an electroconductive film for packaging use.

(3) To ensure a uniform dispersion on a continuously travelling resinous sheet of a large width.

To solve the above-mentioned problems found in the prior art processes, the present invention contemplates to apply a vibrating screen which has been used for screening of a powdery or granular material. Conventionally, the screening or classification by a vibrating screen is normally applied to powder or granules such as those of grain and inorganic, organic or synthetic resin, and may not be commonly used in the dry-system distribution of a fibrous material. The greatst reason why such screening classification is not used in the dry-system distribution of the fibrous material is that fluffy pills are produced due to entanglement of the fiber on a screening mesh or screening plate, resulting in an extremely poor efficiency of distribution.

We have discovered that the above-mentioned problems are solved and the uniform distribution of fiber can be ensured by mounting partitions on a mesh screen provided substantially in contact with the lower portion of a hopper so as to reduce the generation of the pills to the utmost and applying a contrivance to the structure of the partitions to distribute fiber through the openings of the screen, while horizontally moving the fiber on the mesh screen in a reciprocating manner, and consequently, have accomplished the present invention.

According to the present invention, it is possible to distribute a short fibrous material, for example, having a fiber length of 2 to 20 mm, in a small amount down to the lower limit in an amount per unit area of 0.1 $g/m^2$ onto a sheet horizontally travelling at a speed of 30 m/min or less, and it is also possible to uniformly distribute the fibrous material with a deviation of 20% or less in amount per unit area both in the longitudinal and transverse directions with respect to the direction of travelling of the resinous sheet.

The technical background of the present invention will now be described in brief.

Many factors participate in the dry-system distribution of a fibrous material. For example, a mesh screen as used in the present invention is typically made of a wire mesh, and is provided wit a fiber distributing box having side walls on the opposite sides in the direction of vibration thereof as well as on the front and rear sides in the direction of travelling of the sheet. The amount of fiber distributed by the fiber distributing box is directly related to the amount per unit area of fiber distributed onto the sheet. For example, if all of the distributed fiber is uniformly dropped onto the travelling resinous sheet, the relationship between the amount per unit area and the amount of fiber distributed can be represented by an equation:

[amount per unit area of fiber distributed on the sheet ($g/m^2$)] = [distributing rate ($g/m^2$.min.)] × [(area of wire mesh to distribute fiber) − (amplitude area of wire mesh to distribute fiber ($m^2$)]/[a travelling speed of sheet (m/min.) × width of sheet (m)].

Accordingly, even if only the amount of fiber distributed is concerned, an extremely large number of factors participate in the distributing rate, such as the size of opening and the weaving pattern of the wire mesh (screen), vibrating conditions applied to a fiber distributing box including the frequency, amplitude and inclination of the wire mesh and specificities resulting from the quality of fiber such as the generation of pills due to movement of the fiber on the wire mesh. With respect to the amount per unit area of the fiber fixed in the composite resinous sheet obtained by distribution and dropping of the fiber from the wire mesh to be placed on the sheet, followed fixation under heating, the area of the wire mesh determined by subtracting an area thereof corresponding to the amplitude and the distributing rate are to be considered as relevant factors as well as the travelling speed and width of the sheet relating to the areal travelling speed of the sheet.

Further, the factors relating to uniform distribution of the fiber include: (1) the direction of vibration of the fiber distributing box with respect to the travelling direction of the sheet, (2) the length of an approach or preliminary travel section where the thickness of the fiber layer on the wire mesh, i.e., the thickness of the fiber layer on the wire mesh before the distribution is started, is made uniform, corresponding to (3) the height of the exit of the hopper means for uniformly discharging the fiber from the exit of the hopper over the entirety of the opening thereof, and (4) means for minimizing the generation of fluffy pills resulting from the movement of the fiber on the distribution box.

We have investigated various attempts relating to the above-mentioned factors and have discovered that, among others, the combination of a lateral vibration screen provided below the fiber hopper substantially in contact therewith (i.e., in an arrangement substantially avoiding free dropping of the fiber) and a partition, is effective for prevention of pills and uniform distribution of the fiber. Thus the present invention has been accomplished.

These and other objects, features and advantages of the present invention will become more apparent upon a consideration of the following description of the preferred embodiments of the present invention taken in conjunction with the accompanying drawings.

DETAILED DESCRIPTION OF THE INVENTION

Fibrous materials which may be used include single-component short fibers selected from inorganic fibers such as metal, carbon and glass fibers or organic polymeric fibers such as plastic fibers. As used herein, the term "short fiber" means fiber having a length such that entanglement of fiber which is problematic from a process point of view does not readly occur under conditions of operation according to the present invention. The length of the short fiber depends on the type of fiber used, and more specifically, short fibers preferably used are those having a diameter of about 3 to 30 microns and a length of about 2 to 20 mm and controlled to have a specific average length.

Materials of the sheet to be used in the present invention may be, for example, metals or inorganic sheets having an adhesive applied thereon, and they are not particularly limited. However, the use of resinous sheets is particularly preferred when the product is intended to be used as a packaging or molding material. The resinous sheets may comprise a material in the form of a sheet, which comprises a synthetic resin capable of fixing therein or thereon the short fiber material distributed thereon by adhesion through thermal fusion or thermal curing. Accordingly, any of thermoplastic or thermosetting resins can be used as a synthetic resin to be used for this purpose.

The present invention will now be described with reference to the accompanying drawings, while taking an example of a conductive fiber distributing method as a provisional for production of an electroconductive film (conductive fiber-composited resinous sheet) by distributing conductive fiber on a resinous sheet and securing the fibers on the sheet by hot-pressing. The following description is primarily directed to a case using short carbon fiber having an average diameter of 14.5 microns and an average length of 3 mm. The carbon fiber is screenable with a residue of 6 to 7 wt. % by a standard mesh having openings of 2 mm and with a residue of 2 to 3 wt. % by a standard mesh having openings of 4 mm. Further, a polyethylene film (having a thickness of 20 to 100 microns) is used as a resinous sheet.

Figure 1:
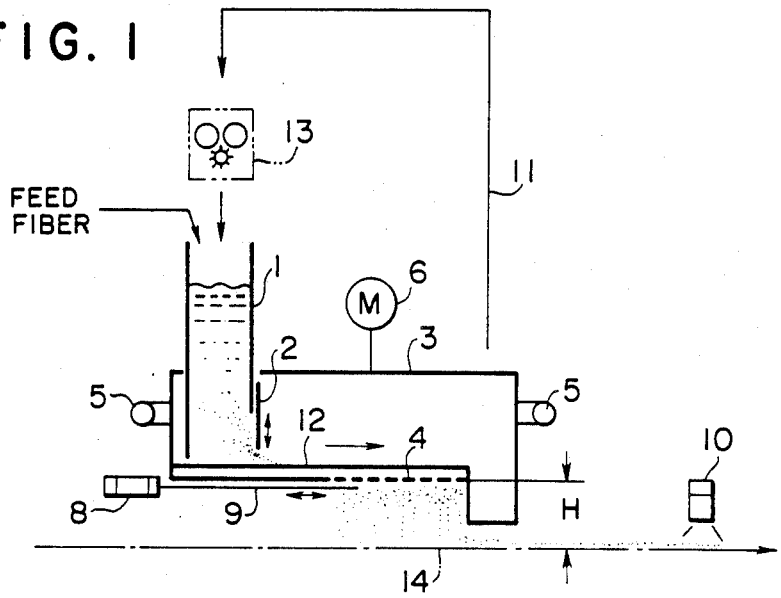
FIG. 1 is a side view illustrating the arrangement of an apparatus according to the present invention.

FIG. 1 is a side view illustrating the arrangement of an apparatus according to the present invention. Referring to this figure, there is provided a fiber receiving hopper 1 in which a disintegrated short fibrous material is stored, so that sheared short fiber as a feed or raw material is charged into the hopper through an upper portion thereof. The hopper is desirably made in the form of a rectangular tube, pipe or chamber in order to diminish the generation of pills during storage therein and to provide a fiber discharge port or exit for permitting the discharge of the fiber in a width equal to or larger than that of the resinous sheet onto which the fiber is to be distributed. The discharge port is provided at the lower portion of the hopper and has a damper 2 for feeding the short fiber onto the distributing wire mesh 4 in a fiber distributing box 3 at a controlled rate. For the purpose of uniformly distributing the fiber onto the resinous sheet over the entire width thereof, the width of the discharge port is preferably equal to or larger than the width of the travelling resinous sheet onto which the fiber is distributed. The height of the discharge port is adjusted by vertical displacement of the damper 2, so that the short fiber within the hopper may be discharged substantially uniformly over the span of the exit in connection with the raking-out action by the vibration of the partitions mounted on the distributing box. If the height of the hopper exit is 65 to 70 mm for carbon fiber having an average length of 3 mm, the fiber is discharged substantially uniformly over the entire port, but the height exceeding 70 mm can result in either an ununiform discharge or an impossibility of discharge. When the discharge amount is too small, the fiber may move on the distributing box in the direction perpendicular to the flow of the fiber due to horizontal reciprocating vibration. Thus, the generation of pills increases, and only fractions having a shorter length are easily dropped, causing classification of fiber and failing to effect uniform distribution. Therefore, the discharge amount has a lower limit.

The portion of the fiber distributing box 3 immediately below the hopper is formed into a bottom made of a flat plate to support the short fiber within the hopper. The length of the subsequent approach travel section L1 where th short fiber discharged from the hopper may be made even to a uniform height on the bottom surface of the distribution box by vibration of the distribution box varies depending on the amount of fiber discharged from the hopper and hence, the openings in a distributing wire mesh are closed by a slide plate 9 provided below the distributing wire mesh over a certain section from the discharge exit as shown in FIG. 1 to ensure a required length of the approach travel section L1. The length of the distribution box is determined so that a required fiber distributing section L2 is adjustably set in addition to the section L1. The fiber distributing box 3 is supported on a sliding or rolling guide bearing 5 and vibrated transversely (in the direction perpendicular to the direction of travelling of the sheet) by the transmission of a reciprocating movement to the distributing box 3 through a drive motor 6 and a reciprocation converting device 7 using a cam/link mechanism and a reversing mechanism.

The distributing box is substantially horizontal, i.e., horizontal or inclined slightly downwardly in the direction of travelling of the resinous sheet. It is to be noted that even if the distributing box was inclined downwardly, the amount of fiber distributed and the uniformity of distribution were not particularly improved under the conditions of the present invention as compared with those in the case of horizontal setting. From the above fact, the horizontal setting of the distributing box which is easily carried out, is more preferable.

It is preferred to select a wire mesh (i.e., mesh screen) 4 having openings with a size substantially equal to the average fiber length of the fibrous material as a feed material, because the fibrous material can be distributed with the average fiber length at maximum. If the size of the openings is too small, the fiber may move on the distributing box in the direction perpendicular to the flow of the fiber due to the vibration. For this reason, the generation of pills increases and only fiber fractions having a shorter fiber length are preferentially distributed to cause classification of the fiber, resulting in an impossibility of continuously conducting uniform distribution of the fiber. If the size of the openings is larger, the fiber may be passed through the mesh as it remain in the form of a bundle, resulting in an ununiformly distributed pattern on the film. It should be noted however that even when the openings have a size substantially different from the average fiber length, the fiber can be uniformly distributed by providing a multi-stage mesh screen.

Preferred conditions were sought by continuously feeding the fiber into the fiber distributing box from the hopper, using a wire mesh having openings of such a size and varying the frequency and amplitude of vibration. As a result, it has been confirmed that the frequency is preferably in the range of 200 to 800 cycles/min., particularly, 300 to 450 cycles/min. and the amplitude is preferably in the range of 3 to 20 times, particularly, 10 to 15 times the average fiber length. The amount of fiber distributed is proportional to the magnitude of the frequency or/and amplitude, but if the frequency is increased too much, the flotation of the fiber on the wire mesh occurs remarkably, resulting in an increased fluctuation in amount of fiber distributed. With a frequency lower than 200 cycles/min., the amount of fiber distributed becomes too small to cause classification of the fiber due to a difference in fiber length as described above, so that continuous uniform distribution becomes impossible. An amplitude of 3 to 20 times, preferably 10 to 15 times, the average fiber length, is selected as described above. With an amplitude smaller than a value of 3 times, the generation of pills is liable to occur and further, the vibration is absorbed by the fiber to lead to a dull movement of the fiber on the screen. On the other hand, if an amplitude exceeds 20 times, the movement of carbon fiber on the wire mesh is not uniform to cause a fluctuation in amount of fiber distributed, resulting in impossibility of uniform distribution. Especially, it is preferred to select a stable range of conditions under which the generation of pills is reduced and moderate disintegration of fiber is effected on the wire mesh, based on the conditions in the above-mentioned ranges for both frequency and amplitude.

A plurality of partition plates 12 are fixedly mounted on the bottom surface of the distributing box at a suitable spacing in parallel with the direction of flow of the fiber and acts to rake out the fiber at the discharge port of the hopper. More specifically, the partition plates fulfil the following effects:

(1) When a large-sized box having an increased width is required to be used in distributing the fiber onto a wide sheet, deformation or bending of the bottom surface of the distributing box and thus the wire mesh, is fatal to uniform distribution, whereas the bottom surface of the distributing box can be reinforced by placing the partition plates.

(2) Upon vibration of the distribution box, the partition plates also vibrate therewith and hence, they serve to rake out the fiber from the lower portion of the hopper, thus making it possible to prevent the clogging of fiber at the exit of the hopper.

(3) The fiber is liable to move in the direction of the vibration which is perpendicular to the direction of proceeding of the fiber in the distributing box, and if this is permitted, the rolling of the fiber is also caused so that pills may be liable to generate, while the movement of the fiber in the direction of vibration is suppressed to the minimum by provision of the partition plates.

(4) Loosely bound pills of the fiber present in the distributing box are disintegrated by contacting the partition plates.

It is preferred that the partition plates are spaced by 10 mm or less, particularly 5 to 6 mm, from the bottom surface of the distributing box and thus from the wire mesh, because stagnation in movement of the fiber on the bottom plate can be prevented by such a spacing. It has been confirmed to be preferable that the distance between the partition plates is 30 to 100 mm and the height of the partition plate is of 20 to 50 mm, and further, a metal plate having a thickness of 2 to 5 mm is used as a partition plate.

In the present invention, the vibration of the distributing box is applied in the direction perpendicular to the direction of travelling of the resinous sheet, i.e., perpendicular to the direction of flow of the fiber on the distributing box. This is desirable for the following reason. The amount of fiber distributed is increased as compared with that in the case of vibration in the same direction as the flow of the fiber, and the uniform distribution of the fiber is provided, while the generation of pills is reduced, and the disintegration efect is ensured between the partition plates as described above.

On the other hand, when the vibrating direction as described above is adopted in the present invention, a considerably strong vibration must be applied to move the fiber on the distributing box, so that a lower limit to the frequency exists. The lower limit to the frequency is related to the amplitude, and it has been confirmed that the lower limit is 400 cycles/min. when the amplitude is 10 mm, and is 200 cycles/min. when the amplitude is 50 mm. Thus, it has been confirmed that the lower limit to the frequency is of the order of 200 cycles/min. as described above for the fiber having an average fiber length of 0.1 to 9 mm.

The apparatus is designed so that the fiber just after discharge from the hopper may be spreaded fully over the discharge port of the hopper by the vibration of the partition plate, but it is still preferred to provide an approach travel section or a certain distance from the fiber discharge port to that portion of the wire mesh at which the distribution is started, in order to ensure a distribution so as to form a fiber layer having an even thickness over the entire width of the distributing box. As described above, the approach travel section L1 is adjusted by opening or closing of the horizontal slide plate 9 provided below the wire mesh.

Preferably, the distance between the wire mesh 4 and the travelling sheet 14 may be as short as possible and more particularly, may be 100 mm at the maximum or less. With a distance exceeding 100 mm, a more uniform distribution can be attained as compared with the prior art, but a distinct spot-like pattern due to the interbundling of fiber may be observed. With a distance of 10 to 20 mm, the interbundling of the fiber would not occur and a particularly uniform distribution can be ensured. Enlarged photographs are shown in Figures as examples of the distribution patterns and in obtaining these enlarged photographs in Example 4 described hereinafter, the respectively distances of fiber dropped were 20 mm (FIG. 3), 100 mm (FIG. 4), and 150 mm (FIG. 5).

The residue remaining on the distributing wire mesh including pills and the fiber dropped outside the travelling sheet are transferred and circulated by a circulating conveyor 11. A disintegrating device 13 can be placed on the way of the transfer to effectively disintegrate pills incorporated in the fed sheared short fiber, pills produced from the long fiber incorporated in the short fiber, or pills generated during transfering and circulation, thereby enabling the fiber to be repeatedly used. The disintegrating device 13 comprises two feed rollers having slip-preventing means such as a groove or uneven surface and a single disintegrating roller having scratching means such as a notched tooth or pin. The disintegrating roller is rotated at a speed higher than that of the feed rollers to scratch the pills put between the feed rollers, thereby fully effecting the disintegration of the pills.

The sheet having the fiber distributed thereon obtained in the above manner is subjected to fixing of the fiber in an appropriate manner depending on the quality of the sheet, and the sheets thus processed are used in respective applications. For example, when the sheet is made of a resin, the thermoplastic or thermosetting property thereof is utilized to conduct the fixing, or when the sheet is made of a metal or inorganic material, an adhesive may be utilized to effect the fixing. For example, for a combination of conductive fiber and a thermoplastic resin sheet, a hot-pressing may be carried out by a process as described in the previously described Japanese Patent Laid-Open Application No. 21735/1983 if molding or shaping material is intended to be produced, or by a process as described in Japanese Patent Application No. 236772/84 developed by a research group to which we belong, if an electrocoductive film suitable as a packaging material is intended to be produced. Such an electroconductive film is used as a packaging film for an electric part, a dustproof film or an electromagnetic wave-shielding film for an electronic machine. In addition, a fiber-composited resinous molding material which has been produced by dispersing and fixing conductive fiber on a resinous sheet made of a synthetic resin as described previously and then pelletizing the resulting sheet, may be employed to produce, e.g., a molded material for a cabinet of a microcomputer for shielding an electromagnetic wave. Resinous sheets obtained by dispersing and fixing various short fibrous materials on a composited or laminated resinous sheet may also be used as wall papers.

On the other hand, resinous sheets having electrically insulating fibers such as plastic fibers and glass fiber dispersed thereon can be used, e.g., for the production of not only insulating substrates for print-wiring but also fiber-composited resinous sheets for laminate molding in general.

The present invention will now be described in more detail by way of Examples.

EXAMPLE 1

Figure 2:
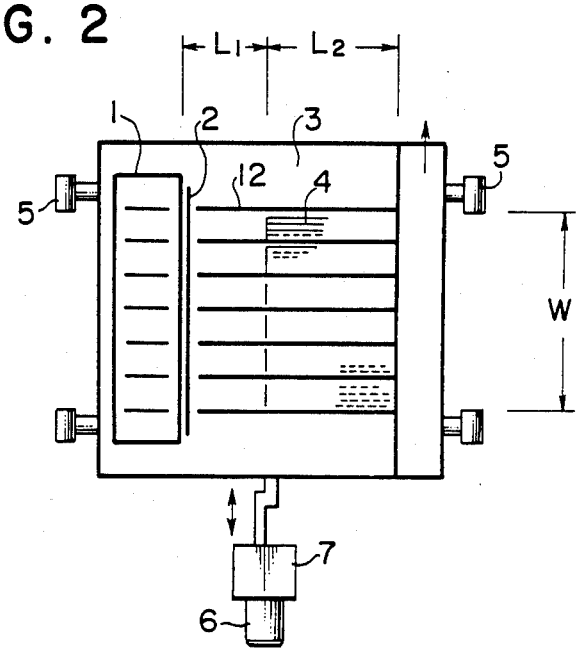
FIG. 2 is a plan view of the apparatus.

Carbon fiber was distributed onto a resinous sheet by using an apparatus shown in FIGS. 1 and 2 and having an approach travel section L1 of 150 mm or more and a distributing section L2 varied in a range of 10 to 250 mm.

More specifically, carbon fiber having an average fiber diameter of 14.5 microns and an average fiber length of 3 mm were continuously distributed onto a polyethylene film having a width of 400 mm while causing the film to travel at a speed in the range of 1 to 20 m/min. by using a distributing box having a distribution width W of 500 mm.

A distributing wire mesh of the distributing box was made of plain weave stainless steel wire mesh and had openings of 3 mm, and the distributing box was set horizontally. The amount of fiber distributed and the uniformity of distribution (in terms of deviation in amount of fiber distributed) were measured at a frequency of 370 cycles/min. and an amplitude of 30 mm. The partition plates having a thickness of 3 mm and a height of 25 mm were placed at a spacing of 4 mm above the wire mesh and at distances of 75 mm spaced from each other.

The amount of fiber distributed on the produced resinous film was measured by using, as a sample, a film piece produced by affixing, onto a travelling resinous film, a double-face adhesive tape having a side length corresponding to the width of the travelling resinous film and a side length in the travelling direction the resinous film varying in the range of 9 to 30 cm depending on the amount of fiber distributed, followed by distribution and fixing fiber on the tape. Ten samples were prepared for each test among those carried out under varying measurement conditions. The ten samples made in this manner were further divided and modified in size into square sample pieces having a side length of 3 to 10 cm depending on the amount of fiber distributed, and such pieces were used as test samples identified according to the positions thereof on the travelling resinous film. That is, the size of each sample plate was changed depending on the amount of fiber distributed, i.e., in 3 cm-square when the amount was large, and in 10 cm-square when the amount was small. This is because the sensitivity of a balance used for the measurement of the weight was 0.1 mg, and the sample size of 10 cm-square was adopted when th amount of fiber distributed was about 1 g/m$^2$ or less. The difference in weight of a film piece having an adhesive thereon before and after the distribution of the fiber thereon was measured to determine the amount of fiber distributed.

The amounts of distributed fiber on the above mentioned plurality of sample pieces were respectively compared with the average thereof, and the absolute differences therebetween were expressed in terms of percentages with respect to the average value. The deviation value as a measure of uniformity of distribution was represented in terms of an arithmetic mean of the thus obtained percentage differences. This is represented by the following equation:

$$\text{Deviation in distributed amounts (\%)} = (100/n) \times \sum^{n} [(\text{measured value of dispersed amount for each sample}) - (\text{average of dispersed amount})]/(\text{average of dispersed amount}),$$

wherein n stands for the number of measured examples.

The results of measurements are given in Table 1. As apparent from Table 1, the amount of fiber distributed is inversely proportional to the travelling speed of the polyethylene sheet (see Test Nos. 1 and 2) and proportional to the area of the wire mesh (see Test Nos. 1 to 6). In addition, the deviation value (%) gradually decreases and the amount of fibers distributed per area become uniform as the amount of fiber distributed increases.

TABLE 1

| Test No. | Conditions | Amount of fiber distributed | Deviation in distributed amount |
|---|---|---|---|
| 1 | $L_2$ = 10 mm<br>S.T.S.* = 20 m/min. | 0.38 g/m$^2$ | 5.3% |
| 2 | $L_2$ = 10 mm<br>S.T.S.* = 10 m/min. | 0.76 g/m$^2$ | 4.0% |
| 3 | $L_2$ = 50 mm<br>S.T.S.* = 20 m/min. | 1.87 g/m$^2$ | 2.6% |
| 4 | $L_2$ = 150 mm<br>S.T.S.* = 20 m/min. | 5.47 g/m$^2$ | 1.5% |
| 5 | $L_2$ = 250 mm<br>S.T.S.* = 10 m/min. | 17.50 g/m$^2$ | 0.9% |
| 6 | $L_2$ = 250 mm<br>S.T.S.* = 1 m/min. | 175.0 g/m$^2$ | 0.7% |

*S.T.S. stands for a sheet travelling speed.

EXAMPLE 2

The same carbon fiber as in Example 1 was distributed onto the surface of a resinous film having a width of 400 mm affixed with the same double-face adhesive tape as in Example 1, while causing the film to travel at a speed of 10 m/min., by using the same fiber distributing apparatus with the frequency and amplitude of the distributing box and the openings in the wire mesh attached to the distributing box being varied.

The partition plates in the distributing box were the same as those in Example 1. A plain weave wire mesh made of stainless steel wire was used and the screening section L2 was set at a constant value of 50 mm.

The results of measurements are given in Table 2. As can be seen from Table 2, the openings in the wire mesh are preferred to have a size equal to or larger than the fiber length. If the size of the openings is constant and the frequency is increased, the amount of fiber distributed increases. If the size of the openings and the frequency are constant, the amount of fiber distributed increases also when the amplitude is increased.

TABLE 2

| Test No. | Conditions: Openings in wire mesh (mm) | Conditions: Frequency (c/min) | Conditions: Amplitude (mm) | Amount of fibers distributed (g/m$^2$) | Deviation in distributed amount (%) |
|---|---|---|---|---|---|
| 7 | 4 | 375 | 30 | 5.50 | 2.1 |
| 8 | 3 | 450 | 20 | 4.25 | 2.3 |
| 9 | 3 | 400 | 30 | 4.15 | 2.0 |
| 10 | 3 | 350 | 30 | 3.75 | 2.2 |
| 11 | 3 | 300 | 30 | 3.05 | 3.7 |

TABLE 2-continued

| Test No. | Conditions: Openings in wire mesh (mm) | Conditions: Frequency (c/min) | Conditions: Amplitude (mm) | Amount of fibers distributed ($g/m^2$) | Deviation in distributed amount (%) |
|---|---|---|---|---|---|
| 12 | 3 | 290 | 50 | 3.75 | 4.3 |
| 13 | 2 | 375 | 30 | 2.15 | 3.2 |
| 14 | 2 | 300 | 50 | 2.00 | 4.4 |
| 15 | 1.68 | 500 | 20 | 1.88 | 5.6 |
| 16 | 1.68 | 380 | 40 | 1.75 | 5.9 |

EXAMPLE 3

Using the same fiber distributing apparatus, travelling polyethylene film and fiber to be distributed as in Example 1, the fiber was distributed onto the travelling polyethylene film, and the uniformity of distribution was evaluated for a predetermined amount of fiber distributed (amount per unit area) set by using a light-penetration method for detecting the distributed amount, while adjusting the frequency and amplitude of the distributing box and the area of the wire mesh by means of the slide plate below the wire mesh of the distributing box.

The used wire mesh of the distributing box was the same as in Example 1, and the travelling speed of the resinous film was 10 m/min.

The results of the measurements are given in Table 3, and as apparent from Table 3, it was confirmed that the carbon fiber-composited polyethylene film having an amount of fiber per unit area in a wide range of 1 to 20 $g/m^2$ could be produced with the fiber uniformly distributed thereon by the adjustment of the amount of fiber distributed by use of th amount-detecting device according to the light-penetration scheme.

TABLE 3

| Test No. | Set amount of fiber distributed ($g/m^2$) | Deviation value in measured amount (%) |
|---|---|---|
| 17 | 1 | 1.2 |
| 18 | 3 | 0.8 |
| 19 | 10 | 0.5 |
| 20 | 20 | 0.5 |

EXAMPLE 4

The same fiber to be distributed in Example 1, was distributed onto a travelling polyethylene film, and the patterns of fiber distributed on the film depending on the distances of fiber dropped between the wire mesh of the distributing box and the travelling film were observed.

Figure 3:
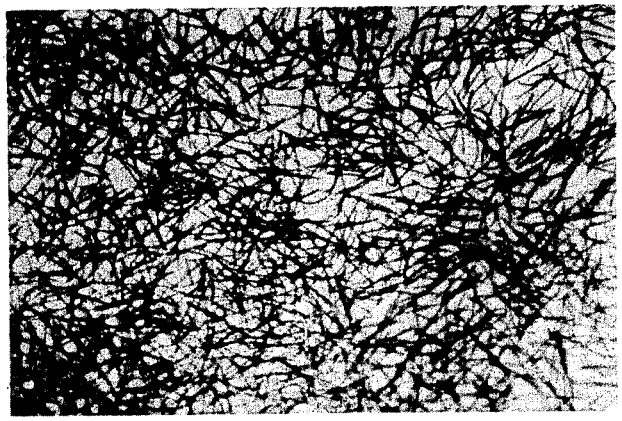
FIGS. 3 to 5 are respectively enlarged photographs (each in a magnification of 3) illustrating a pattern of carbon fiber distributed on a resinous sheet while using various distances H (mm) of dropping of screened fiber from screening wire mesh of a fiber distributing box to the resinous sheet according to Example 4 appearing hereinafter.

FIG. 3 shows a pattern of fiber distributed from the surface of the wire mesh when the distance of fiber dropped was 20 mm.

Figure 4:
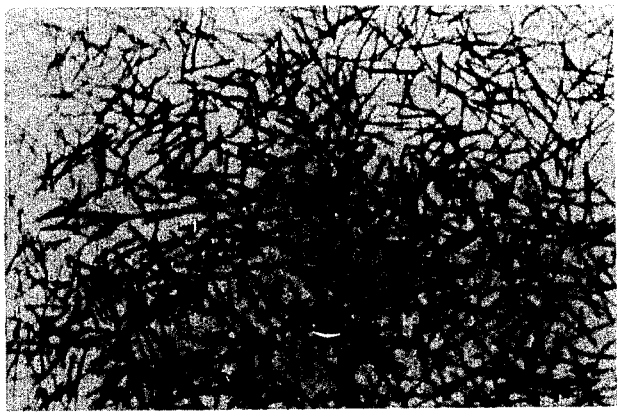
Figure 5:
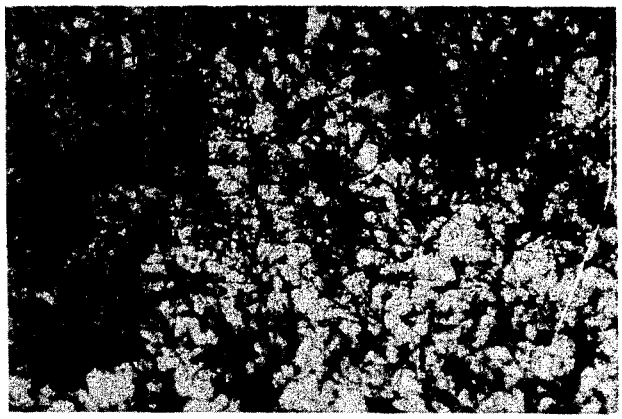

FIGS. 4 and 5 respectively show patterns of fiber distributed when the distances of fibers dropped were respectively 100 mm and 150 mm.

As can be seen from FIGS. 3 to 5, if the distance of fiber dropped from the wire mesh onto the film was 100 mm or less, then a mesh-like uniform pattern of distributed short fiber was provided. If the distance of fiber dropped exceeded 100 mm, then the distributed fiber could cause entanglement during the dropping in the space between the wire mesh of the distributing box and the travelling polyethylene film, resulting in a spot-like pattern, and thus, the uniform distribution was not exhibited. Such a pattern is shown in FIG. 5 wherein the distance of fiber dropped was 150 mm.

EXAMPLE 5

Using the same fiber distributing apparatus as in Example 1, nylon fiber having an average fiber diameter of 30 microns and an average fiber length of 5 mm as a short fibrous material was distributed onto the surface of polyethylene film having a width of 400 mm and provided with an adhesive thereon.

It was confirmed that as conditions under which the uniform distribution was ensured, a frequency of 250 cycles/min. and an amplitude of 50 mm were appropriate for a stainless steel wire mesh of plain weave having openings of 4.5 mm. The film was caused to travel at a speed of 10 m/min., and the patterns of nylon fiber distributed onto the film depending on the distances of fiber dropped between the wire mesh of the distributing box and the travelling resinous film was observed in the same manner as in Example 4. The used partition plates in the distributing box were the same as those in Example 1.

Figure 6:
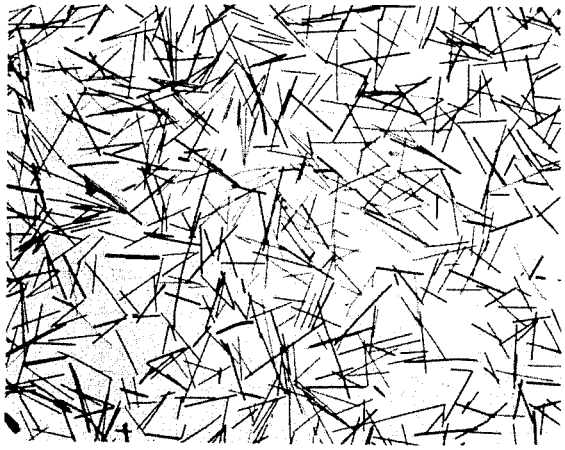
FIGS. 6 to 8 are respectively enlarged photographs (each in a magnification of two) illustrating a pattern of nylon fiber distributed on a resinous sheet for respective distances of dropping of fiber according to Example 5 appearing hereinafter.
Figure 7:
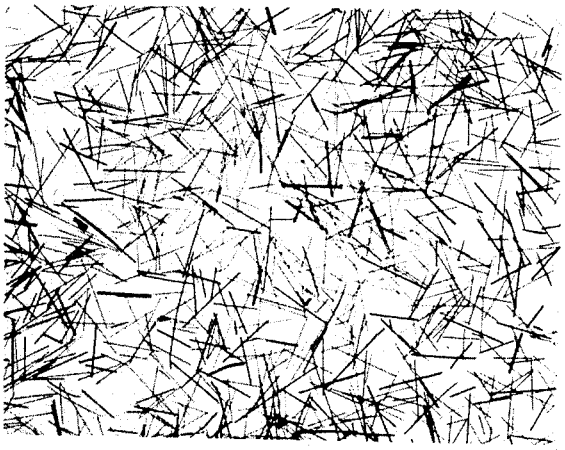
Figure 8:
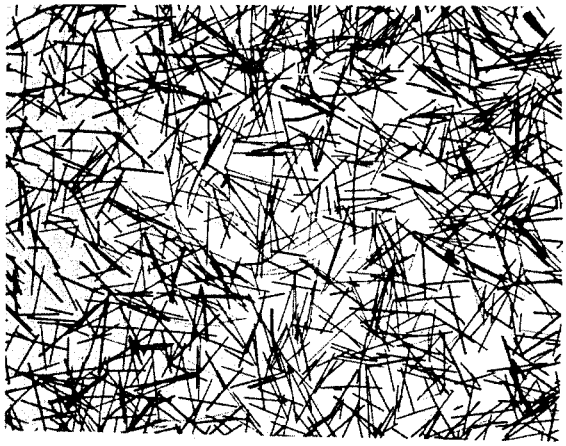

The distance of fiber dropped was varied from 50 mm to 500 mm to observe the patterns of fiber distributed on the film. The results showed that if the distance of fiber dropped was 200 mm or less, the uniform distribution was ensured, but if the distance exceeded 200 mm, then the entanglement of the fiber occurred to prevent the uniform distribution. In FIGS. 6, 7, and 8, there are shown patterns of fiber distributed when the distances of fiber dropped were 50 mm, 200 mm and 500 mm, respectively.

As apparent from the foregoing Examples, with process and apparatus according to the present invention, it is possible to dispersively distribute more simply and uniformly, onto a travelling sheet, fibers which have neither been distributed easily nor dispersed uniformly because they are flexible and liable to form fluffy pills, thus making it possible to continuously produce, in a lower cost, electroconductive films, sheets or fiber-reinforced composite molded products which will be expected in application as packaging materials and molding materials. Particularly, the process according to the present invention is useful as a process for producing a thin film-like composite functional material because of possibility of dispersively and uniformly distributing an extremely small amount of sheared short fiber.

What is claimed is:

1. A process for distributing a short fibrous material onto a horizontally travelling sheet, comprising the steps of:

(a) feeding a disintegrated short fibrous material into a hopper comprising a substantially hollow chamber disposed above the travelling sheet having a width, and having a fiber discharge port at a lower portion of a side wall located on the side in the travelling direction of the sheet, and (b) substantially horizontally vibrating a mesh screen in a direction perpendicular to the travelling direction of the sheet to drop and distribute the fiber through the mesh screen onto the sheet travelling below the said mesh screen, said mesh screen substantially horizontally extending forwardly from below said hopper in the travelling direction of the sheet with a predeterminded distance spaced apart from said travelling sheet, said mesh screen having a width equal to or larger than that of said travelling sheet and having partitions provided thereabove for suppressing the movement of the fiber in the direction perpendicular to the travelling direction of the sheet;

said mesh screen having a substantially closed approach travel section extending below the hopper and an open screening section subsequent thereto extending in the travelling direction of the sheet and wherein the length of said approach travel section is 0.5 to 4 times the height of the fiber discharge port as measured from the fiber discharge port to the downstream end thereof.

2. The process according to claim 1, wherein the distance of fibrous material dropped onto the travelling sheet after being screened is 100 mm or less.

3. The process according to claim 1, wherein the sheet is caused to travel at a speed of 30 m/min. or less.

4. The process according to claims 1, wherein said mesh screen is formed as a part of a vibrating box having side walls provided at the opposite sides in the vibration direction thereof.

5. The process according to claim 1, further including the step of recirculating the residue remaining on the mesh screen after the step (b) and the fiber dropped out of the width of the sheet, into the hopper while disintegrating them above the hopper or in an upper portion of the hopper.

6. The process according to claim 1, wherein the fibrous material has a fiber length of about 2 to 20 mm and a fiber diameter of about 3 to 30 μm.

7. The process according to claim 1, wherein the fibrous material comprises an electroconductive fiber.

8. The process according to claim 1, wherein the horizontally travelling sheet is a resinous sheet.

9. The process according to claim 1, wherein the size of the openings in the mesh screen is substantially equal to the fiber length.

10. The process according to claim 1, wherein the mesh screen is vibrated at a frequency of 200 to 800 cycles/min. and an amplitude of a level 3 to 20 times the fiber length.

11. The process according to claim 1, wherein the height of the partitions above the mesh screen is 20 to 50 mm, the distance between adjacent partitions is 35 to 75 mm and the spacing between the mesh screen and the partitions is 10 mm or less.

12. An apparatus for distributing a short fibrous material onto a horizontally travelling sheet, comprising:

(a) means for causing the horizontal travel of a sheet having a width;

(b) a hopper comprising a substantially hollow chamber disposed above the travelling sheet and having a fiber discharge port at a lower portion of a side wall on the side in the travelling direction of the sheet;

(c) a mesh screen horizontally extending forwardly from below said hopper in the travelling direction of the sheet with a predetermined distance spaced apart from said travelling sheet, said mesh screen having a width equal to or larger than that of the travelling sheet and having a plurality of partitions provided thereabove in parallel with the travelling direction of the sheet for restricting the movement of the fiber in the direction perpendicular to the travelling direction of the sheet;

said mesh screen having a substantially closed approach travel section extending below the hopper and an open screening section extending in the travelling direction of the sheet and wherein the length of said approach travel section as measured from the fiber discharge port of the hopper to the downstream end thereof is 0.5 to 4 times the height of the fiber discharge port; and (d) means for horizontally vibrating said mesh screen in the direction substantially perpendicular to the travelling direction of the sheet.

13. An apparatus according to claim 12, wherein said approach travel section is provided by closing the openings in the mesh screen by means of a slide plate mounted under the mesh screen.

14. The apparatus according to claim 12, wherein the distance of the fibrous material dropped onto the travelling sheet after being screened is 100 mm or less.

15. The apparatus according to claim 12, wherein the means for causing the horizontal travel of the sheet comprises a guide roller and a tension roller, or an endless belt.

16. The apparatus according to claim 12, wherein the fiber discharge port of the hopper has a width equal to or larger than that of the sheet, and is provided with a dumper for adjusting the height of the fiber discharge port.

17. The apparatus according to any of claim 12 16, wherein the means for horizontally vibrating the mesh screen comprises a vibration generating device having a cam/link mechanism and a guide roller connected to said vibration generating device.

18. The apparatus according to claim 12, wherein the height of the partitions above the mesh screen is 20 to 50 mm, the distance between adjacent partitions is 35 to 75 mm, and the spacing between the mesh screen and the partitions is 10 mm or less.

19. The apparatus according to claim 12, wherein the size of the openings in the mesh screen is substantially equal to the fiber length.

20. The apparatus according to claim 12, further including a disintegrating device comprising two feed rollers placed above the hopper or at an upper portion within the hopper and a single disintegrating roller having a rotational speed higher than that of the feed rollers.

21. The apparatus according to claim 12, wherein said mesh screen is formed as a part of a vibrating box having side walls mounted thereon at the opposite sides in the vibration direction thereof.

22. The apparatus according to claim 12, wherein said approach travel section is provided by closing the openings in the mesh screen by means of a slide plate mounted under the mesh screen.

* * * * *

UNITED STATES PATENT AND TRADEMARK OFFICE

CERTIFICATE OF CORRECTION

PATENT NO. : 4,705,702

DATED : November 10, 1987

INVENTOR(S) : Masaaki SHIMADA et al.

It is certified that error appears in the above-identified patent and that said Letters Patent is hereby corrected as shown below:

In the specification, column 2, line 39, change "$gm^2$" to --$g/m^2$--.

In the claims, claim 13, line 1, change "An" to --The--.
Claim 17, line 1, delete "16".
Claim 22, cancel without prejudice to the subject matter thereof.

On the title page "22 Claims" should read -- 21 Claims --.

Signed and Sealed this

Second Day of August, 1988

*Attest:*

*Attesting Officer*

DONALD J. QUIGG

*Commissioner of Patents and Trademarks*